US006709313B2

(12) United States Patent
Kondo et al.

(10) Patent No.: US 6,709,313 B2
(45) Date of Patent: Mar. 23, 2004

(54) APPARATUS FOR PRODUCING POLISHING SOLUTION AND APPARATUS FOR FEEDING THE SAME

(75) Inventors: Kaoru Kondo, Kokubunji (JP); Naoki Tsuda, Kokubunji (JP); Norihiro Takasaki, Kitakyushu (JP); Yoshifumi Bandou, Kitakyushu (JP); Masumi Hino, Kitakyushu (JP); Kenyou Miyata, Tokyo (JP)

(73) Assignee: Rion Co., Ltd., Tokyo (JP)

( * ) Notice: Subject to any disclaimer, the term of this patent is extended or adjusted under 35 U.S.C. 154(b) by 57 days.

(21) Appl. No.: 09/986,988

(22) Filed: Nov. 13, 2001

(65) Prior Publication Data

US 2002/0061722 A1 May 23, 2002

(30) Foreign Application Priority Data

Nov. 17, 2000 (JP) ..... 2000-351096
Nov. 17, 2000 (JP) ..... 2000-351097

(51) Int. Cl.[7] ..... B24B 49/00; B24B 51/00

(52) U.S. Cl. ..... 451/6; 451/8; 451/60; 451/446

(58) Field of Search ..... 250/564, 565, 250/574, 576; 356/336–343; 377/11, 12; 451/6, 8, 36, 41, 60, 63, 446, 447

(56) References Cited

U.S. PATENT DOCUMENTS

| | | | | |
|---|---|---|---|---|
| 4,794,806 | A | 1/1989 | Nicoli et al. | |
| 5,365,559 | A | * 11/1994 | Hsueh et al. | 377/10 |
| 5,791,970 | A | * 8/1998 | Yueh | 451/8 |
| 5,835,211 | A | 11/1998 | Wells et al. | |
| 6,106,728 | A | * 8/2000 | Iida et al. | 210/743 |
| 6,137,572 | A | * 10/2000 | DeFreez et al. | 356/336 |
| 6,315,955 | B1 | * 11/2001 | Klein | 422/73 |
| 6,338,671 | B1 | * 1/2002 | Kawashima et al. | 451/87 |
| 6,406,364 | B1 | * 6/2002 | Kimura et al. | 451/446 |
| 6,465,802 | B1 | * 10/2002 | Matsuda | 250/574 |

* cited by examiner

*Primary Examiner*—Timothy V. Eley
(74) *Attorney, Agent, or Firm*—Nixon & Vanderhye P.C.

(57) ABSTRACT

Apparatus for producing a polishing solution composed of pure water and abrasive grains, the apparatus including a preparation tank to prepare a polishing solution containing abrasive grains at a predetermined concentration, by mixing an abrasive grain-containing slurry and pure water, and a circulation device for circulating the thus prepared polishing solution to keep the solution in a suspended state. The circulation device includes a circulation conduit and a flow-controllable bypass conduit fluidly associated with the circulation conduit providing a constant flow rate and having a light-extinction type particle detector for monitoring the polishing solution so as to detect large abrasive grains having a particle size not less than a predetermined value and measure the number of the large abrasive grains.

20 Claims, 3 Drawing Sheets

APPARATUS FOR PRODUCING POLISHING SOLUTION AND APPARATUS FOR FEEDING THE SAME

BACKGROUND OF THE INVENTION

The present invention relates to an apparatus for producing a polishing solution and an apparatus for feeding the polishing solution, and more particularly, to an apparatus for producing a chemical-mechanical polishing solution for use in polishing in a semiconductor device-manufacturing process and an apparatus for feeding such a polishing solution which are capable of controlling the generation of abrasive grains having a particle size larger than a predetermined value in the polishing solution in an in-line and continuous manner.

Semiconductor devices have been required to be highly integrated and operated at a higher speed and with a lower consumption of electric power. In the semiconductor manufacturing process, for the purpose of flattening the surface of metallic wiring or layer insulation film formed on a semiconductor wafer during an intermediate step, the surface of the semiconductor wafer is subjected to chemical-mechanical polishing using, for example, a silica-based polishing solution (CMP slurry). In recent years, in view of mass-production of the semiconductor devices and difficulty in controlling the composition of the polishing solution, the polishing solution has been produced during the polishing step. Upon the production of the polishing solution, in order to achieve an accurate polishing rate, the concentration of abrasive grains in the polishing solution must be strictly controlled. Further, the abrasive grains contained in the polishing solution tend to be gradually agglomerated together, and the thus agglomerated abrasive grains in the form of large grains tend to cause undesirable scratches on the surface of the semiconductor wafer. Therefore, it becomes more important to monitor and control the size of the abrasive grains contained in the polishing solution.

Upon the production of the polishing solution, the polishing solution as produced is sampled and diluted with pure water. The diluted polishing solution is then irradiated with a predetermined quantity of light to measure an intensity of transmitted light or scattered light, followed by determining the number of large abrasive grains contained in the polishing solution from the measured light intensity. The reason why such a sampling method must be used for controlling the polishing solution is as follows. That is, if the polishing solution is directly measured on the production line, the number of abrasive grains contained in it cannot be accurately measured. This is because the flow rate of the solution tends to be fluctuated by pulsation flow of the solution due to a pump or the like. Also, in the case of the above silica-based polishing solution, the solution contains adequate silica particles having an average particle size of about 0.2 $\mu$m at a concentration as high as $10^{13}$/ml and has a lesser content of large abrasive grains to be controlled. Therefore, for example, in the case where the agglomerated large abrasive grains of not less than 3 $\mu$m are detected by directly measuring the attenuation of irradiated light due to the existence of the large abrasive grains, it is difficult to measure such a light attenuation due to the large abrasive grains since considerable light attenuation is caused by the existence of a large amount of the adequate abrasive grains.

Meanwhile, since the detection of the large abrasive grains contained in the polishing solution requires a relatively long time, the polishing solution actually used will be changed in particle size distribution from the initially sampled one. More specifically, the polishing solution used contains a larger amount of agglomerated abrasive grains than that upon sampling since the agglomeration of the abrasive grains proceeds further. As a result, in the polishing step, there is a possibility that the semiconductor wafer suffers from considerable scratches beyond expectation.

SUMMARY OF THE INVENTION

An object of the present invention is to provide an apparatus for producing a chemical-mechanical polishing solution for use in a polishing step of a semiconductor device-manufacturing process which is capable of controlling the generation of large (coarse) abrasive grains having a particle size larger than a predetermined (fixed or designed) value in the polishing solution in an in-line and continuous manner with a high accuracy.

Another object of the present invention is to provide an apparatus for feeding a chemical-mechanical polishing solution for use in a polishing step of a semiconductor device-manufacturing process which is capable of controlling the generation of large (coarse) abrasive grains having a particle size larger than a predetermined (fixed or designed) value in the polishing solution in an in-line and continuous manner with a still higher accuracy.

To accomplish the aims, in a first aspect of the present invention, there is provided an apparatus for producing a polishing solution mainly comprising pure water and abrasive grains, which apparatus comprises:

- a preparation tank (2) for preparing a polishing solution containing abrasive grains at a predetermined concentration, by mixing a abrasive grain-containing slurry as a feedstock and pure water with each other; and
- a circulation device (L4) for circulating the thus prepared polishing solution so as to keep the solution in a suspended state.

The circulation device (L4) includes a circulation conduit (56) for circulating the polishing solution, and a flow-controllable bypass conduit (561) fluidly associated with the circulation conduit (56) and is provided with a particle detector (7) for monitoring the polishing solution so as to detect large abrasive grains not smaller than a predetermined value and measure the number of the large abrasive grains.

The particle detector (7) is of the light-extinction type and is adapted for irradiating a predetermined quantity of light on a flow cell (74) fitted in the bypass conduit (561) so as to detect an attenuation of the light transmitted through the polishing solution flowing through the flow cell (74) due to the large abrasive grains.

The flow cell (74) allows the polishing solution to flow through it at a constant flow rate by flow control of the bypass conduit (561).

In a second aspect of the present invention, there is provided a production apparatus according to the above first aspect, also including a polishing solution feed device (L5) connected to a downstream side of the circulation device (L4) for feeding the polishing solution circulated through the circulation device (L4) to a polishing apparatus (9).

The polishing solution feed device (L5) includes a feed conduit (57) for feeding the polishing solution, and a flow-controllable bypass conduit (571) fluidly associated with the feed conduit (57). The flow-controllable bypass conduit (571) is provided with a particle detector (8) for monitoring the polishing solution so as to detect large abrasive grains not smaller than a predetermined value and measure the number of the large abrasive grains.

The particle detector (8) is of the light-extinction type and is adapted for irradiating a predetermined quantity of light on a flow cell fitted in the bypass conduit (571) so as to detect an attenuation of the light transmitted through the polishing solution flowing through the flow cell due to the large abrasive grains.

The flow cell allows the polishing solution to flow through it at a constant flow rate by flow control of the bypass conduit (571).

In a third aspect of the present invention, there is provided an apparatus for feeding a polishing solution mainly comprising pure water and abrasive grains to a polishing apparatus (9), which includes a feed conduit (57) extending from a polishing solution feed source (S1) to the polishing apparatus (9), and a flow-controllable bypass conduit (571) fluidly associated with the feed conduit (57), the flow-controllable bypass conduit (571) being provided with a particle detector (8) for monitoring the polishing solution so as to detect large abrasive grains not smaller than a predetermined value and measure the number of the large abrasive grains.

The particle detector (8) is of the light-extinction type and is adapted for irradiating a predetermined quantity of light on a flow cell (84) fitted in the bypass conduit (57) so as to detect an attenuation of the light transmitted through the polishing solution flowing through the flow cell (84) due to the large abrasive grains.

The flow cell (84) allows the polishing solution to flow through it at a constant flow rate by flow control of the bypass conduit (571).

DETAILED DESCRIPTION OF THE INVENTION

Figure 1:
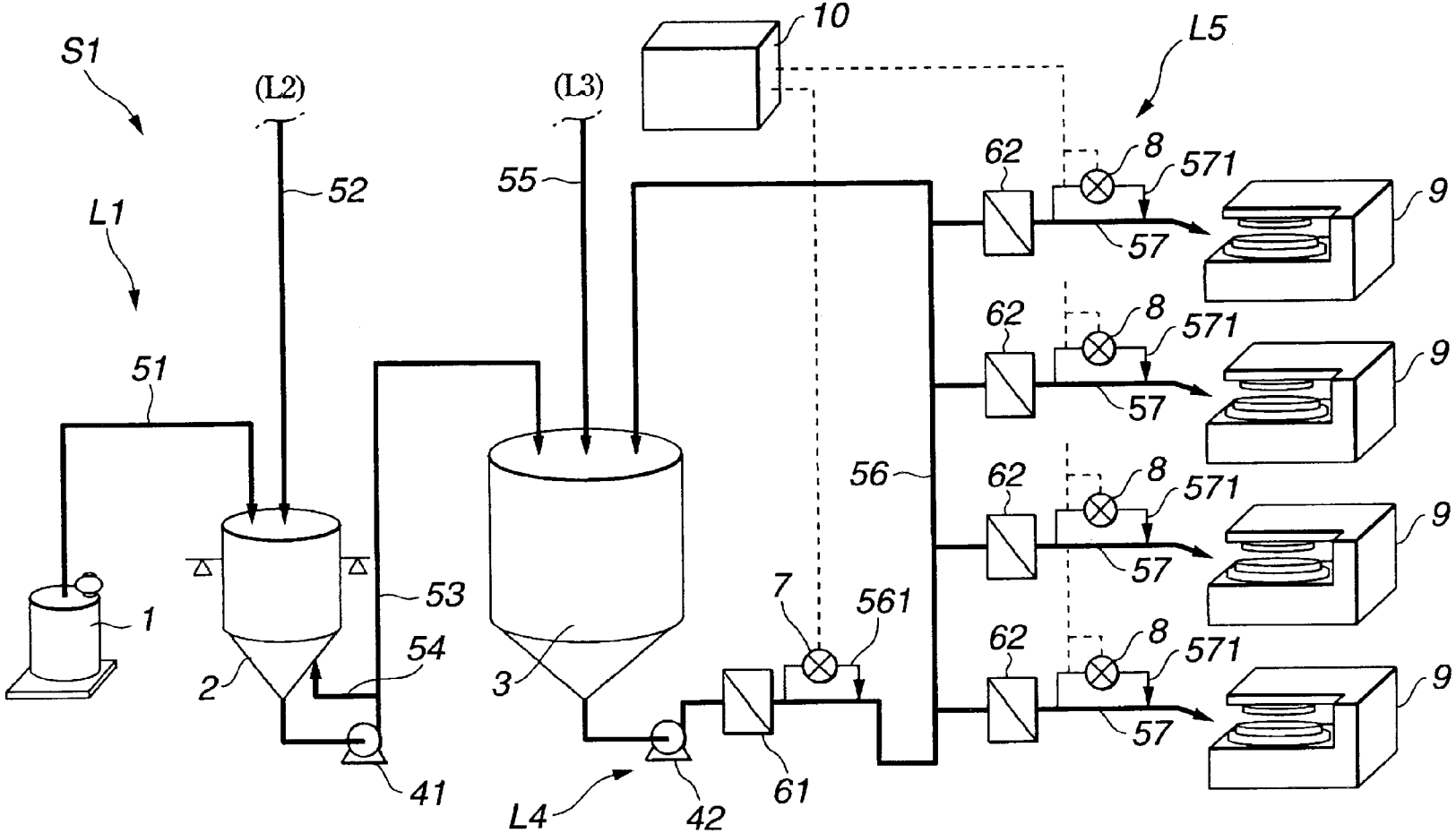
FIG. 1 is a schematic flow diagram showing an apparatus for producing a polishing solution according to the present invention.

In the production apparatus according to the first embodiment of the present invention, a polishing solution containing abrasive grains at a predetermined concentration is prepared in a preparation tank by mixing raw materials together, and then the thus prepared polishing solution is circulated through a circulation device so as to keep the solution in a suspended state. The circulation device includes a circulation conduit for circulating the polishing solution therethrough, and a flow-controllable bypass conduit fluidly associated with the circulation conduit. The bypass conduit is provided with a particle detector for monitoring the polishing solution. The particle detector is adapted for irradiating a predetermined quantity of light on a flow cell fitted in the bypass conduit so as to detect an attenuation of the light transmitted through the polishing solution flowing through the flow cell, due to the existence of large abrasive grains not smaller than a predetermined value in the polishing solution. With such arrangements in which the flow-controllable bypass conduit is provided with the particle detector, and the flow cell allows the polishing solution to flow therethrough at a constant flow rate by flow control of the bypass conduit, it is possible to adequately regulate the amount of the polishing solution flowing through the flow cell without adverse influences due to pulsation flow caused in the circulation conduit, etc. Further, since the number of abrasive grains having a particle size smaller than a predetermined value in the polishing solution flowing through the flow cell is totally reduced, it is possible to effectively distinguish the attenuation of the transmitted light due to the large abrasive grains having not smaller than a predetermined value from that due to the abrasive grains having a particle size smaller than a predetermined value.

In the above production apparatus, the particle detector is preferably provided with a correction means for correcting deterioration in sensitivity thereof due to the abrasive grains having a particle size smaller than a predetermined value when detecting the attenuation of the transmitted light due to the large abrasive grains not smaller than a predetermined value. The correction means is capable of enhancing the sensitivity of the particle detector for detecting the attenuation of the transmitted light due to the large abrasive grains.

In a preferred embodiment of the present invention, the above production apparatus further includes a polishing solution feed device connected to a downstream side of the circulation device for feeding the polishing solution circulated through the circulation device to a polishing apparatus, in order to supply a higher-grade polishing solution to the polishing apparatus. In addition, the polishing solution feed device includes a feed conduit for feeding the polishing solution, and a flow-controllable bypass conduit fluidly associated with the feed conduit. The bypass conduit is provided with a particle detector for monitoring the polishing solution so as to detect large abrasive grains not smaller than a predetermined value and measure the number of the large abrasive grains. The particle detector is of a light-extinction type and adapted for irradiating a predetermined quantity of light on a flow cell fitted in the bypass conduit so as to detect an attenuation of the light transmitted through the polishing solution flowing through the flow cell, due to the existence of the large abrasive grains. The flow cell is arranged such that the polishing solution can flow therethrough at a constant flow rate by flow control of the bypass conduit.

More specifically, in the above production apparatus, the polishing solution circulated through the circulation device is fed to the polishing apparatus through the polishing solution feed device. In addition, the particle detector of the same type as that used in the bypass conduit of the circulation device is also provided in the bypass conduit of the polishing solution feed device and adapted for irradiating a predetermined quantity of light on the flow cell fitted in the bypass conduit so as to detect an attenuation of the light transmitted through the polishing solution flowing through the flow cell due to the existence of the large abrasive grains. In this case, similarly to the production apparatus according to the first embodiment of the present invention, with such arrangements in which the flow-controllable bypass conduit is provided with the particle detector, and the flow cell allows the polishing solution to flow therethrough at a constant flow rate by flow control of the bypass conduit, it is possible to adequately regulate the amount of the polishing solution flowing through the flow cell without adverse influences due to pulsation flow caused in the feed conduit, etc. Further, since the number of abrasive grains having a particle size smaller than a predetermined value in the polishing solution flowing through the flow cell is totally reduced, it is possible to effectively distinguish the attenuation of the transmitted light due to the large abrasive grains not smaller than a predetermined value from that due to the abrasive grains having a particle size smaller than a predetermined value.

In the production apparatus according to each embodiment of the present invention, the particle detector is preferably provided with a correction means for correcting deterioration in sensitivity thereof due to the abrasive grains having a particle size smaller than a predetermined value when detecting the attenuation of the transmitted light due to the large abrasive grains not smaller than a predetermined value. The correction means is capable of enhancing a sensitivity of the particle detector for detecting the attenuation of the transmitted light due to the large abrasive grains.

Figure 2:
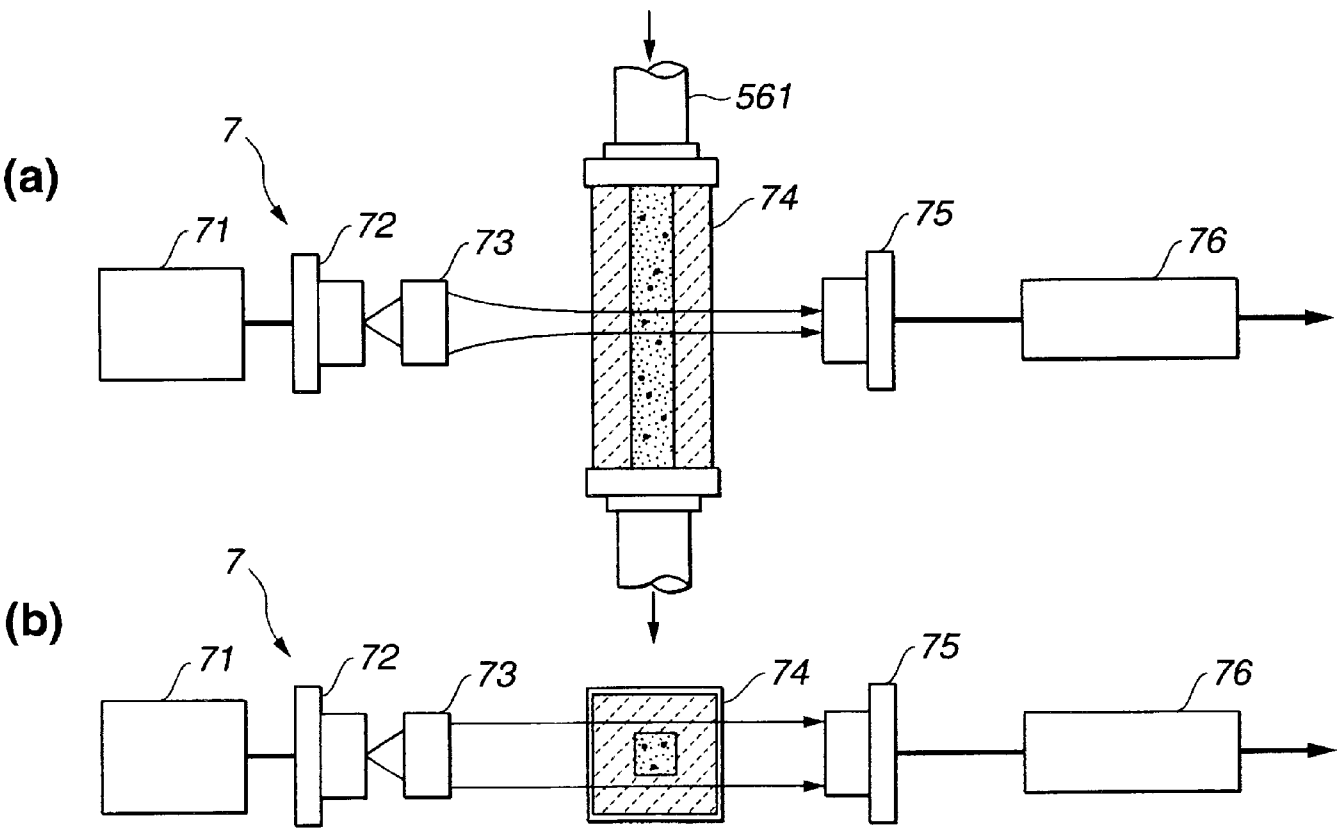
FIGS. 2(*a*) and 2(*b*) respectively show partially broken side and plan views of a particle detector used in the production apparatus of the present invention, for explaining a detection principle of the particle detector.

A preferred form of the apparatus for producing a polishing solution according to the present invention will be described below by referring to the accompanying drawings in which FIG. 1 is a schematic flow diagram showing an apparatus for producing a polishing solution according to the present invention; FIGS. 2(*a*) and 2(*b*) respectively show partially broken side and plan views of a particle detector used in the production apparatus of the present invention, for explaining a detection principle of the particle detector; and FIGS. 3(*a*) and 3(*b*) are graphs illustrating output signals emitted from a sensor of the particle detector and control pulse signals converted therefrom. Meanwhile, in the schematic flow diagram shown in FIG. 1, valves, meters and the like are omitted therefrom. In the following preferred form of the present invention, the apparatus for producing a polishing solution is hereinafter referred to merely as "production apparatus" for simplicity.

The production apparatus of the present invention is capable of producing a chemical-mechanical polishing solution mainly comprising pure water and abrasive grains which is typically used for polishing semiconductor devices, for example, silica-based polishing solution (CMP slurry). By using the production apparatus of the present invention, it is possible to produce a high-grade polishing solution in an on-site manner.

The silica-based polishing solution contains fumed silica abrasive grains and pure water as main components. The fumed silica abrasive grains have a particle size of usually less than 5 $\mu$m, preferably less than 3 $\mu$m, more preferably 0.1 to 2 $\mu$m. The content of the abrasive grains in the polishing solution is usually 10 to 30% by weight. Also, the polishing solution may contain suitable additives, if required. As the additives contained in polishing solution used for polishing the surface of metal wiring or removing plugs, there may be exemplified those components capable of oxidizing these metals or plugs, such as usually hydrogen peroxide. As the additives contained in polishing solution used for polishing a silicon layer, there may be exemplified alkalis such as potassium hydroxide. These acids or alkalis as additives may be added in the form of an aqueous solution thereof and fed through an additive feed device (L3) as explained hereinafter.

As shown in FIG. 1, the production apparatus of the present invention includes at least a preparation tank (2) for preparing a polishing solution containing abrasive grains at a predetermined concentration by mixing a raw slurry as a feedstock, i.e., a slurry containing abrasive grains having, for example, a particle size of less than 3 $\mu$m, with pure water; and a circulation device (L4) for circulating the thus prepared polishing solution so as to keep the solution in a suspended state.

Usually, the preparation tank (2) is supplied with the raw slurry having a predetermined abrasive grain concentration from a fluid feed device (L1), and with pure water from a pure water feed device (L2) (not shown). The preparation tank (2) is connected at its downstream or rear side thereof with a polishing solution tank (3) for storing the polishing solution prepared in the preparation tank (2). The circulation device (L4) is so arranged that the polishing solution stored in the polishing solution tank (3) can be circulated therethrough. Also, the polishing solution tank (3) is connected to the additive feed device (L3) to supply the above additives thereto.

The fluid feed device (L1) is a device for feeding under pressure the raw slurry from a fluid tank (1) to the preparation tank (2), and is constituted by a conduit extending from the fluid tank (1) to the preparation tank (2), a constant flow pump (not shown) such as bellows-type pump, and the like. The fluid tank (1) serves for storing the raw slurry to be supplied to the preparation tank (2), and is constituted from a fixed-type or portable-type container having a corrosion resistance.

The fluid tank (1) includes a conduit (not shown) connectable to a slurry delivering container receiving the raw slurry introduced from outside. The raw slurry is fed under pressure from the slurry delivering container through the conduit by means of an inert carrier gas such as nitrogen. Further, the fluid tank (1) is fitted with an inert gas feed conduit (not shown), and supplied with the inert gas therethrough in order to prevent the contact between the slurry and air.

The preparation tank (2) also serves as a storage tank for adjusting the concentration of the polishing solution to a predetermined value and temporarily storing the thus prepared polishing solution. The preparation tank (2) is constituted, for example, by a container lined with fluororesin in order to enhance a corrosion resistance thereof. The preparation tank (2) is provided with a meter for weighing the raw slurry or pure water received, an optical-type, conductivity-type or capacitance-type point-measurable level gauge for measuring the liquid amount, or the like (all not shown). Further, the preparation tank (2) is fitted with an inert gas feed conduit (not shown), and supplied with the inert gas there it in order to prevent contact between the slurry and air.

The pure water feed device (L2) serves for feeding diluting pure water to the preparation tank (2), and includes a conduit (52) extending from a known water-purifying device for preparing and separating ultrapure water using ion exchange resins or the like, to the preparation tank (2). Usually, the pure water prepared in the water-purifying device is fed under pressure to the preparation tank (2) by means of a pump fitted to the water-purifying device.

In the case of a small-capacity production apparatus, the polishing solution prepared in the preparation tank (2) is directly fed through the circulation device (L4) to the polishing apparatus (9) (i.e., a surface plate device). In general, in order to stably supply the polishing solution to a plurality of polishing apparatuses (9), the above polishing solution tank (3) is provided at a downstream or rear side of the preparation tank (2). The production apparatus as shown in FIG. 1 is arranged such that the polishing solution prepared in the preparation tank (2) is transferred through a pump (41) and a conduit (53) to the polishing solution tank (3). Meanwhile, in FIG. 1, there is shown a return conduit (54) for monitoring the concentration of the polishing solution and returning the polishing solution to the preparation tank (2) according to requirements.

The polishing solution tank (3) is a storage tank for feeding the prepared polishing solution to the polishing apparatus, and is constituted by a corrosion-resistant container, for example, fluororesin-lined container, since the above additives such as acids and alkalis are added thereto in the form of an aqueous solution. The polishing solution tank (3) is provided with an optical-type, conductivity-type or capacitance-type point-measurable level gauge for measuring the amounts of the polishing solution or the additives added. Further, the polishing solution tank (3) is fitted with an inert gas feed conduit (not shown), and supplied with the inert gas therethrough in order to prevent the contact between the polishing solution and air.

The additive feed device (L3) for supplying the additives to the polishing solution tank (3) serves for feeding under pressure the additives from a separate additive tank (not shown) to the polishing solution tank (3), and is constituted by a conduit (not shown) for taking out the additives from the additive tank, a constant flow pump (not shown) such as magnet pump which is capable of varying a flow rate of liquid pumped and maintaining the flow rate at a constant value, and a conduit (55) for feeding the additives to the polishing solution tank (3).

The polishing solution tank (3) further includes an agitating mechanism for continuously agitating the polishing solution stored therein by jets in order to prevent the abrasive grains contained in the solution from being precipitated or agglomerated. Although the agitating mechanism may be constituted by a rotary device such as agitating blades, the mechanism is preferably constituted by a jet nozzle (not shown) fitted at a tip end of a return side of the circulation conduit (56) of the circulation device (L4), namely at a tip end of the circulation conduit (56) inserted into the polishing solution tank (3). Such a jet nozzle is capable of generating jets in the vicinity of the bottom of the polishing solution tank (3) by a jetting energy of the polishing solution in the form of a pressurized fluid discharged from the tip end of the return side of the circulation conduit (56).

Meanwhile, in the production apparatus of the present invention, a mixing tank (not shown) may be disposed between the preparation tank (2) and the polishing solution tank (3) in order to preliminarily mix the polishing solution supplied from the preparation tank (2) with the additives supplied from the additive feed device (L3), thereby enhancing the mixing efficiency therebetween. The resultant mixture of the polishing solution and the additive is then fed to the polishing solution tank (3) and stored therein.

The circulation device (L4) is arranged so as to circulate the polishing solution stored in the polishing solution tank (3) therethrough not only for maintaining the thus prepared polishing solution in a uniformly suspended state and preventing the abrasive grains contained in the polishing solution from being agglomerated together, but also for readily feeding the polishing solution to the polishing solution feed device (L5) as described hereinafter. More specifically, the circulation device (L4) is constituted by the circulation conduit (56) for taking out the polishing solution from the polishing solution tank (3) and returning the solution to the tank (3), a pump (42) for forcibly feeding the polishing solution through the circulation conduit (56), or the like.

As described above, the polishing solution is in the form of a dispersion in which the abrasive grains having, for example, a particle size of less than 3 $\mu$m are dispersed. In the polishing solution, the agglomeration of the abrasive grains proceeds with the passage of time, resulting in growth of large abrasive grains of not less than 3 $\mu$m (hereinafter referred to as "large abrasive grains"). If the polishing solution containing such large abrasive grains is used in the polishing apparatus (9), the wafer treated with the polishing solution will suffer from considerable scratches. Therefore, in order to solve the above problems, the circulation conduit (56) is provided at an upstream side of the particle detector (7) with a circulation filter (61) for capturing the large abrasive grains not smaller than the predetermined value, specifically those abrasive grains having, for example, a particle size of not less than 3 $\mu$m.

As the circulation filter (61), there may be used ordinary fluid filters including a disc-shaped polypropylene filtering material having a pore size of about 1.0 to about 5.0 $\mu$m. Meanwhile, the circulation device (L4) may also include a concentration measuring device (not shown) to which the polishing solution is fed through a bypass conduit (not shown) in order to control the concentration of the additive added to the polishing solution tank (3).

In the production apparatus of the present invention, the circulation conduit (56) of the circulation device (L4) is further provided with a flow-controllable bypass conduit (561) constituted by a flow control valve, an orifice, etc. (not shown), in order to control the generation and the number of the large abrasive grains in the polishing solution. The bypass conduit (561) is provided thereon with a particle detector (7) for monitoring the polishing solution so as to detect the large abrasive grains not smaller than a predetermined value, for example, those abrasive grains having a particle size of not less than 3 $\mu$m, and measure the number of the large abrasive grains.

As described above, for example, if the average particle size of adequate abrasive grains contained in the silica-based polishing solution is less than 3 $\mu$m. the particle size of the abrasive grains tend to become increased up to not less than 3 $\mu$m, in some cases several $\mu$m, since the agglomeration thereof proceeds with the passage of time. The number of such large abrasive grains is, however, extremely small as compared to the number of the adequate abrasive grains contained in the polishing solution. For example, in the case where the average particle size of adequate abrasive grains contained in the polishing solution is about 0.2 $\mu$m, the number of the adequate abrasive grains is $10^{13}$/ml while the number of the large abrasive grains which tend to cause scratches on the wafer, is as small as about 10 to 1,000/ml. Therefore, as the particle detector (7), there may be used those detectors of a light-extinction type which are adapted for irradiating a predetermined quantity of light on a flow cell (74) fitted in the bypass conduit (561) so as to detect an attenuation of the light transmitted through the polishing solution flowing through the flow cell (74) due to the existence of the large abrasive grains.

The basic structure of the light-extinction type particle detector is already known, and is so arranged as to irradiate a light on a fluid (slurry) flowing through the transparent flow cell, and detect a quantity of the transmitted light by a light detecting device. Specifically, the particle detector (7) serves for determining the particle size of the abrasive grains passed through the flow cell by measuring the change (reduction) in quantity of transmitted light due to light absorption, reflection and scattering by the abrasive grains passed through the flow cell, and for measuring the number of the abrasive grains from the frequency of the change in quantity of transmitted light outputted in the form of pulses.

More specifically, as shown in FIG. 2, the particle detector (7) comprises as essential components, a light source (72) such as tungsten lamp, light-emitted diode and semiconductor laser which is capable of emitting a predetermined quantity of light by supplying an electric power thereto from a power circuit (71), a condensing lens (73) for converging the light emitted from the light source (72), for example, into a flat band-like light beam, the flow cell (74) which is formed into, for example, a cylindrical shape having a rectangular section and is made of a transparent material such as quartz glass, a light detecting device such as photodiode and optical arrays for detecting an intensity of the light emitted from the light source (72) and transmitted through the flow cell (74), an amplifier (76) for amplifying an output signal from the light detecting device (75), an arithmetic processing unit (arithmetic circuit including memory, arithmetic element, etc.) for processing the output signal from the light detecting device (75), or the like.

In general, upon the measurement of the large abrasive grains contained in the polishing solution, it is required to detect the extremely small number of the large abrasive grains contained in the polishing solution having an abrasive grain concentration of 10 to 30% by weight. Therefore, depending upon the set value for the lower limit of the particle size of the large abrasive grains to be detected, the measured value tends to be considerably affected (i.e., suffer from large noises) by absorption, reflection and scattering of light on the adequate abrasive grains, resulting in inaccurate detection of the large abrasive grains. Further, if the fluid (polishing solution) to be measured causes a pulsation flow due to the operation of devices such as pump, it is difficult to accurately measure the number of the abrasive grains.

On the contrary, in the present invention, since the particle detector (7) is provided on the flow-controllable bypass conduit (561), it is possible to prevent the measurement of the abrasive grains from being adversely affected by the pulsation flow of the solution in the circulation conduit (56) and reduce the adverse influences (noises) due to the adequate abrasive grains, thereby enabling the extremely small number of the large abrasive grains to be accurately detected. Namely, the flow cell is so arranged as to allow the polishing solution to flow therethrough at a constant flow rate by the flow control of the bypass conduit (561). The flow rate of the polishing solution passed though the flow cell (74) is usually set to 1 to 500 ml/min., and the flow velocity thereof is usually set to 0.1 to 1 m/sec. In order to further enhance an accuracy of detection of the large abrasive grains, the light transmission distance in the flow cell (74) is preferably set to 0.1 to 100 mm.

In addition, in the production apparatus of the present invention, in order to detect the large abrasive grains contained in the circulating polishing solution at a still higher accuracy, the particle detector (7) may also be provided with a correction means for correcting the deterioration in sensitivity thereof due to the abrasive grains having a particle size smaller than a predetermined value (i.e., adequate abrasive grains) when detecting the attenuation of the transmitted light due to the large abrasive grains not smaller than the predetermined value. Such a correction means is usually provided in the above arithmetic processing unit.

Figure 3:
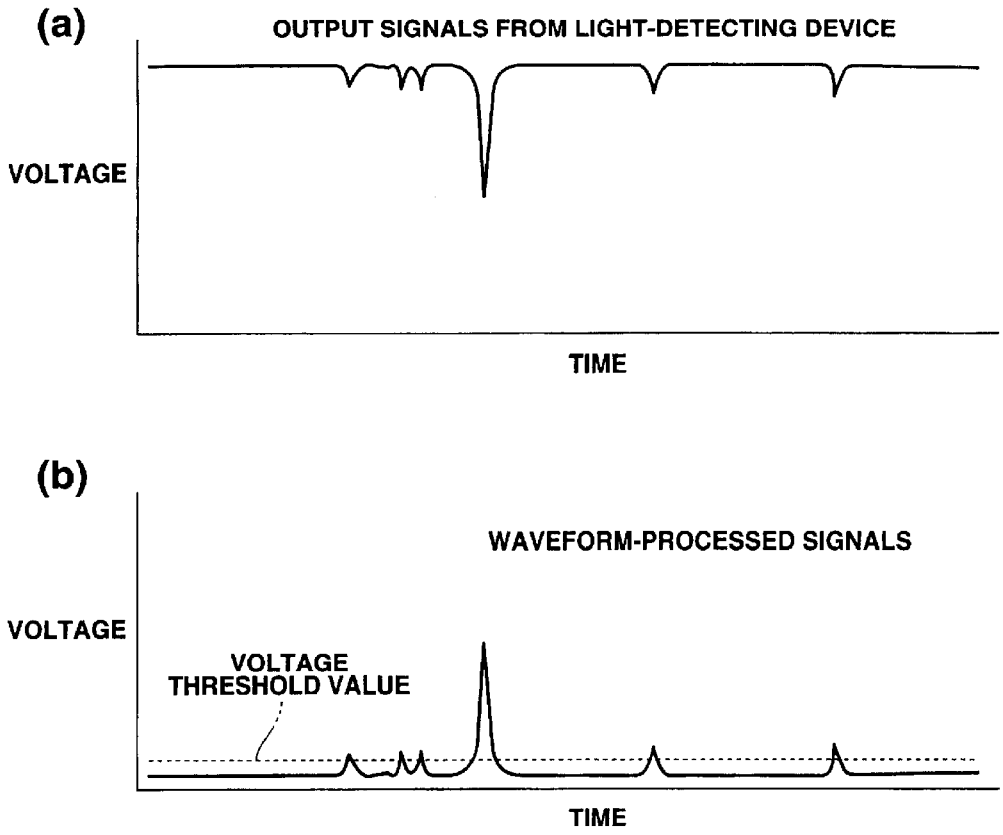
FIGS. 3(*a*) and 3(*b*) are graphs respectively illustrating output signals emitted from a sensor of the particle detector, and control pulse signals converted therefrom.

More specifically, in the particle detector (7), as shown in FIG. 3(*a*), the light detecting device (75) outputs pulse signals corresponding to light signals received. The obtained pulse signals are subjected to waveform processing by the arithmetic processing unit and converted into those signals having a waveform as shown in FIG. 3(*b*). Then, the thus converted signals are compared with a voltage threshold value as a lower limit predetermined by a control specimen in order to count the number of signal peaks higher than the threshold value. As the control specimen, there may be used a polishing solution containing a specific amount (e.g., 15% by weight) of abrasive grains having a particle size smaller than a predetermined value (e.g., those grains having a particle size of less than 3 $\mu$m), and standard polystyrene latex particles having the same particle size as that of abrasive grains to be detected (e.g., 3 $\mu$m).

The production apparatus of the present invention may further include a control device (10) for controlling the fluid feed device (L1), the preparation tank (2), the pure water feed device (L2), the polishing solution tank (3), the additive feed device (L3), the circulation device (L4) and the polishing solution feed device (L5) as described hereinafter, and for generating an alarm on the basis of the detection signals of the particle detector (7). The control device (10) is mainly constituted by an input unit for converting signals from the respective devices into digital signals, an arithmetic processing unit such as memory-containing program controller or computer, and an output unit for converting control signals emitted from the arithmetic processing unit, into analog signals.

Next, the process for producing a polishing solution using the production apparatus of the present invention is described. In the production apparatus of the present invention, the raw slurry containing abrasive grains at a predetermined concentration is first weighed and fed from the fluid tank (1) to the preparation tank (2). Further, after a predetermined amount of pure water is weighed and fed through the pure water feed device (L2) to the preparation tank (2), the raw slurry and pure water are mixed together in the preparation tank (2) to prepare a polishing solution. In this case, the slurry concentration of the polishing solution is measured by a concentration meter fitted on the return conduit (54) while circulating the solution through the pump (41) and the return conduit (54) to the preparation tank (2), thereby finely controlling the amounts of the raw slurry and pure water fed to the preparation tank on the basis of the measured values, and adjusting the abrasive grain concentration (slurry concentration) of the polishing solution, for example, to 15% by weight.

The polishing solution prepared in the preparation tank (2) is fed to the polishing solution tank (3) through the conduit (53). Then, the polishing solution received in the polishing solution tank (3) is supplied, if required, with the additives from the additive feed device (L3) through the conduit (55). The thus supplied additives are mixed with the polishing solution by means of the agitating mechanism provided in the polishing solution tank (3), thereby preparing a polishing solution containing the abrasive grains and the additives at predetermined concentrations. Meanwhile, the concentration of the additives contained in the polishing solution may be adjusted by feeding a part of the polishing solution flowing through the circulation conduit (56) of the circulation device (L4) to a concentration meter to measure the additive concentration of the polishing solution, and controlling the amount of the additives fed from the additive feed device (L3) or the amount of the polishing solution fed through the conduit (53) on the basis of the measured value.

The polishing solution having a predetermined composition which is finally prepared in the polishing solution tank (3) is circulated through the circulation device (L4). More specifically, the thus prepared polishing solution is taken out from the polishing solution tank (3), circulated through the circulation conduit (56) by means of the pump (42) of the circulation device (L4), and then returned black to the polishing solution tank (3), thereby maintaining the abrasive grains contained in the polishing solution in a uniformly suspended state. Upon the circulation of the polishing solution, the agglomerated large abrasive grains not smaller than the predetermined value are captured by the circulation filter (61) fitted in the circulation conduit (56), thereby enabling the polishing solution substantially free from the large abrasive grains to be circulated through the circulation conduit (56).

Meanwhile, the content of the large abrasive grains in the polishing solution is increased as the residence time of the solution in the polishing solution tank (3) and the circulation device (L4) becomes longer and as the performance of the circulation filter (61) becomes more deteriorated. On the contrary, in the production apparatus of the present invention, a part of the polishing solution circulated through the circulation conduit (56) is fed to the bypass conduit (561) where the polishing solution is monitored by the particle detector (7) provided thereon. More specifically, the particle detector (7) provided on the bypass conduit (561) irradiates a predetermined quantity of light on the flow cell (74) through which the polishing solution is passed, so as to detect the attenuation of the transmitted light due to the existence of the large abrasive grains not smaller than the predetermined value, for example, those grains having a particle size of not less than 3 $\mu$m, thereby measuring the number of the large abrasive grains.

In this case, with such arrangements in which the particle detector (7) is provided on the flow-controllable bypass conduit (561) and the flow cell (74) allows the polishing solution to flow therethrough at a constant flow rate by the flow control of the bypass conduit (561), it is possible to adequately regulate the amount of the polishing solution flowing through the flow cell (74) without adverse influences by pulsation flow of the polishing solution caused in the circulation conduit (56) due to the operation of devices such as pump, etc. In addition, since the polishing solution flowing through the flow cell (74) is totally reduced in number of the abrasive grains having a particle size smaller than the predetermined value, it is possible to effectively distinguish the attenuation of the transmitted light due to the large abrasive grains not smaller than the predetermined value (e.g., those grains having a particle size of not less than 3 $\mu$m) from that due to the adequate abrasive grains having a particle size smaller than the predetermined value (e.g., those grains having a particle size of less than 3 $\mu$m), thereby enabling the number of the large abrasive grains to be accurately measured.

Also, the correction means provided in the particle detector (7) serves for correcting the deterioration in sensitivity of the detector due to the adequate abrasive grains having a particle size smaller than the predetermine value when detecting the attenuation of the transmitted light due to the large abrasive grains, thereby further enhancing the sensitivity of the detector for detecting the attenuation of the transmitted light due to the large abrasive grains. As a result, in the production apparatus of the present invention, it is possible to control the generation and the number of the large abrasive grains not smaller than the predetermined value in the polishing solution circulated through the circulation conduit (56) of the circulation device (L4) not only in an in-line and continuous manner but also at a high accuracy.

Thus, in the production apparatus of the present invention, since the prepared polishing solution is effectively controlled in such an in-line manner, it is possible to stably feed a high-grade polishing solution to the polishing apparatus (9). Further, the production apparatus of the present invention may include a warning means for generating an alarm when the particle detector (7) detects such a condition that the number of the large abrasive grains per a predetermined flow rate exceeds the control limit. The means for controlling the number of the abrasive grains as well as the above warning means may be usually provided in the above control device (10). Also, the production apparatus may be arranged such that the feed of the polishing solution to the polishing apparatus (9) is stopped when the alarm is generated by the warning means. Further, the above in-line control of the polishing solution also enables immediate replacement of the filtering material when the circulation filter (61) is deteriorated, thereby stably maintaining a high quality of the polishing solution fed to the polishing apparatus (9).

Also, in the production apparatus of the present invention, the circulation conduit (56) of the circulation device (L4) may be provided with a second circulation filter (not shown) arranged in parallel to the circulation filter (61) such that the flow of the polishing solution is changed over from the (first) circulation filter (61) to the second circulation filter when the particle detector (7) detects such a condition that the number of the large abrasive grains not smaller than the predetermined value per a predetermined flow rate exceeds the control limit. Namely, with such an arrangement in which the two circulation filters for capturing the large abrasive grains are arranged in parallel with each other in the circulation conduit (56), when the circulation filter (61) is deteriorated in its performance, the flow of the polishing solution can be immediately changed over from the circulation filter (61) to the second circulation filter having a normal performance, so that a high-quality polishing solution can be stably fed to the polishing apparatus (9) without stoppage of operation of the production apparatus.

The circulation device (L4) is usually provided with a plurality of feed conduits for feeding the polishing solution to a plurality of polishing apparatuses (9). The feed conduits are respectively controlled so as to permit or prevent the flow of the polishing solution to the respective polishing apparatuses (9) depending upon the operational condition of each polishing apparatus (9) by opening or closing a gate valve provided in the respective feed conduits. Therefore, if a certain polishing apparatus is stopped for a long period of time, the polishing solution retained in the corresponding feed conduit tends to suffer from agglomeration of abrasive grains contained therein. As a result, notwithstanding the polishing solution fed from the circulation device (L4) is free from large abrasive grains, there will be caused such an inconvenience that the polishing solution containing such agglomerated large abrasive grains is fed to the polishing apparatus (9), whereby the wafer tends to suffer from scratches.

In view of the above problem, in order to feed a higher-quality polishing solution to the respective polishing apparatuses (9), the production apparatus of the present invention may further include a polishing solution feed device (L5) as specified below. That is, as shown in FIG. 1, in the production apparatus of the present invention, there may be provided the polishing solution feed device (L5) which is connected to a downstream or rear side of the circulation device (L4), and is so arranged as to prevent the generation of the large abrasive grains in a similar manner to that of the circulation device (L4), and feed the polishing solution circulated through the circulation device (L4) to the polishing apparatuses (9).

More specifically, the polishing solution feed device (L5) is usually constituted by a plurality of feed lines for feeding the polishing solution to the respective polishing apparatuses (9). The feed lines are respectively provided with a feed conduit (57) and a bypass conduit (571) associated with the feed conduit. The bypass conduit (571) is arranged such that the polishing solution flowing therethrough can be controlled by a flow regulating valve, an orifice and the like (not shown). In addition, the bypass conduit (571) is provided with a particle detector (8) for monitoring the polishing solution so as to detect the large abrasive grains not smaller than the predetermined value and measure the number of the large abrasive grains. Further, in the feed conduit (57) of the polishing solution feed device (L5), a feed filter (62) of the same type as the circulation filter (61) for capturing the large abrasive grains contained in the polishing solution is disposed on a upstream side of the particle detector (8).

Similarly to the particle detector (7), the particle detector (8) may be of a light-extinction type and is so arranged as to irradiate a predetermined quantity of light on a flow cell through which the polishing solution is passed, and detect the attenuation of the light transmitted therethrough due to the large abrasive grains not smaller than the predetermined value. The light transmission distance of the flow cell of the particle detector (8) is preferably set to 0.1 to 100 mm. The flow cell of the particle detector (8) is arranged such that the polishing solution can flow therethrough at a constant flow rate by the flow control of the bypass conduit (571).

The particle detector (8) has the same structure as that of the particle detector (7) shown in FIGS. 2(*a*) and 2(*b*). The particle detector (8) may be provided with a correction means for correcting the deterioration in sensitivity of the detector due to the abrasive grains having a particle size smaller than the predetermined value when detecting the attenuation of the transmitted light due to the large abrasive grains not smaller than the predetermined value. Such a correction means may be provided in an arithmetic processing unit for the particle detector (8) similarly to that for the particle detector (7).

In the above polishing solution feed device (L5), when the polishing solution circulated through the circulation conduit (56) of the circulation device (L4) is fed to the respective polishing apparatuses (9) therethrough, the particle detector (8) provided on the bypass conduit (571) serves for irradiating a predetermined quantity of light on the flow cell through which the polishing solution is flowed, and detecting the attenuation of the transmitted light due to the large abrasive grains not smaller than the predetermined value, for example, those grains having a particle size of not less than 3 $\mu$m. thereby measuring the number of the large abrasive grains contained in the polishing solution.

With the above arrangements in which the particle detector (8) is provided on the flow-controllable bypass conduit (571) similarly to the particle detector (7), and the flow cell allows the polishing solution to flow therethrough at a constant flow rate by the flow control of the bypass conduit (571), it is possible to adequately regulate the amount of the polishing solution flowing through the flow cell without adverse influences due to pulsation flow of the polishing solution caused in the feed conduit (57) by the operation of devices such as pump. Further, since the number of the abrasive grains having a particle size smaller than the predetermined value in the polishing solution flowing through the flow cell is totally reduced, when the transmitted light from the flow cell is analyzed by the arithmetic processing unit, it is possible to effectively distinguish the attenuation of the transmitted light due to the large abrasive grains not smaller than the predetermined value from that due to the adequate abrasive grains having a particle size smaller than the predetermined value, thereby enabling the number of the large abrasive grains to be accurately measured.

Also, the correction means provided in the particle detector (8) serves for correcting the deterioration in sensitivity of the detector due to the adequate abrasive grains having a particle size smaller than the predetermine value when detecting the attenuation of the transmitted light due to the large abrasive grains, thereby further enhancing the sensitivity of the detector for detecting the attenuation of the transmitted light due to the large abrasive grains. As a result, in the production apparatus provided with the polishing solution feed device (L5) according to the present invention, it is possible to control the generation and the number of the large abrasive grains not smaller than the predetermined value in the polishing solution fed through the feed conduit (57) to the polishing apparatus (9) not only in an in-line and continuous manner but also at a high accuracy.

Thus, in the production apparatus of the present invention, since the polishing solution flowing through the feed conduit (57) is effectively controlled in such an in-line manner, it is possible to feed a still higher-grade polishing solution to the polishing apparatus (9). Further, the production apparatus of the present invention may include a warning means for generating an alarm when the particle detector (8) detects such a condition that the number of the large abrasive grains per a predetermined flow rate exceeds the control limit. Such a warning means may be provided in the above control device (10). Also, the production apparatus may be arranged such that the feed of the polishing solution through the polishing solution feed device (L5) is immediately stopped when the alarm is generated by the warning means. As a result, it becomes possible to prevent the polishing solution containing the large abrasive grains from being fed to the respective polishing apparatuses (9), so that the wafer can be effectively prevented from undergoing processing defects such as scratches in the polishing apparatuses (9).

Also, in the production apparatus of the present invention, the feed conduit (57) of the polishing solution feed device (L5) may be provided with a second feed filter (not shown) arranged in parallel to the feed filter (62) such that the flow of the polishing solution is changed over from the (first) feed filter (62) to the second feed filter when the particle detector (8) detects such a condition that the number of the large abrasive grains not smaller than the predetermined value per a predetermined flow rate exceeds the control limit. Namely, with such an arrangement in which the two feed filters for capturing the large abrasive grains are arranged in parallel with each other in the feed conduit (57) similarly to those of the above circulation device (L4), when the feed filter (62) is deteriorated in its performance, the flow of the polishing solution can be immediately changed over from the feed filter (62) to the second feed filter having a normal performance, whereby a high-quality polishing solution can be stably fed to the polishing apparatuses (9) without stoppage of feeding of the polishing solution.

Meanwhile, in the present invention, the predetermined value of the particle size of the abrasive grains to be controlled may be appropriately set according to the polishing conditions. Also, by the provision of the particle detectors (7) and (8), not only the abrasive grains but also other particles (foreign matters) generated in the devices such as pumps and valves as well as in the conduits can be well controlled.

In the production apparatus of the present invention, since the specific particle detector of a light-extinction type is provided on the bypass conduit of the circulation conduit in order to accurately measure the large abrasive grains not smaller than the predetermined value, it is possible to control the generation and the number of the large abrasive grains not smaller than the predetermined value in the polishing solution prepared in the preparation tank and circulated through the circulation device in an in-line and continuous manner at a high accuracy, thereby ensuring stable feed of a high-grade polishing solution to the respective polishing apparatuses. Further, when the particle detector is provided with the specific correction means, it is possible to further enhance the sensitivity of the detector for detecting the large abrasive grains not smaller than the predetermined value.

Furthermore, in the production apparatus provided with the specific polishing solution feed device according to the present invention, since the specific particle detector of a light-extinction type is provided on the bypass conduit of the polishing solution feed conduit in order to accurately measure the large abrasive grains not smaller than the predetermined value, it is possible to control the generation and the number of the large abrasive grains not smaller than the predetermined value in the polishing solution fed through the feed conduit to the respective polishing apparatuses in an inline and continuous manner at a high accuracy, thereby ensuring stable feed of a higher-grade polishing solution to the respective polishing apparatuses. As a result, the wafer to be processed by the polishing apparatus can be effectively prevented from suffering from processing defects such as scratches or the like. Further, in the case where the particle detector is provided with the specific correction means, it is possible to further enhance the sensitivity of the detector for detecting the large abrasive grains not smaller than the predetermined value.

What is claimed is:

1. An apparatus for producing a polishing solution comprising pure water and abrasive grains, which apparatus comprises:

a preparation tank (2) for preparing a polishing solution containing abrasive grains at a predetermined concentration, for mixing a abrasive grain-containing slurry as a feedstock and pure water; and a circulation device (L4) for circulating the thus prepared polishing solution to keep the solution in a suspended state, said circulation device (L4) comprising a circulation conduit (56) for circulating the polishing solution, and a flow-controllable bypass conduit (561) fluidly associated with the circulation conduit (56) and provided with a particle detector (7) for monitoring the polishing solution so as to detect large abrasive grains not smaller than a predetermined value and measure the number of the large abrasive grains, wherein said particle detector (7) is a light-extinction particle detector irradiating a predetermined quantity of light on a flow cell (74) fitted in a bypass conduit (561) so as to detect an attenuation of the light transmitted through the polishing solution flowing through the flow cell (74), the attenuation indicating the presence of the large abrasive grains, said flow cell (74) allowing the polishing solution to flow therethrough at a constant flow rate by flow control of the bypass conduit (561).

2. An apparatus according to claim 1, wherein the particle detector (7) comprises a correction means for correcting deterioration in sensitivity thereof due to the abrasive grains having a particle size smaller than the predetermined value when detecting the attenuation of the transmitted light due to the large abrasive grains.

3. An apparatus according to claim 1, further comprising a polishing solution tank (3) for storing the polishing solution prepared in the preparation tank (2), the circulation device (L4) allowing the polishing solution stored in the polishing solution tank (3) to be circulated therethrough.

4. An apparatus according to claim 3, wherein the polishing solution tank (3) is supplied with an additive through an additive feed device (L3).

5. An apparatus according to claim 1, wherein the circulation conduit (56) is provided with a first circulation filter (61) for capturing the large abrasive grains, on an upstream side of the particle detector (7).

6. An apparatus according to claim 5, wherein the circulation conduit (56) is provided with a second circulation filter arranged parallel to the first circulation filter (61) so as to change over the flow of the polishing solution circulated, from the first circulation filter (61) to the second circulation filter when the particle detector (7) detects such a condition that the number of the large abrasive grains per a predetermined flow rate of the polishing solution exceeds a control limit.

7. An apparatus according to claim 1, further comprising a warning means for generating an alarm when the particle detector (7) detects such a condition that the number of the large abrasive grains per a predetermined flow rate of the polishing solution exceeds a control limit.

8. An apparatus according to claim 1, wherein the particle detector (8) is provided with a comparison means comprising a specimen prepared by dispersing a standard substance in a polishing solution having a predetermined composition.

9. An apparatus according to claim 1, further comprising a polishing solution feed device (L5) connected to a downstream side of the circulation device (L4) for feeding the polishing solution circulated through the circulation device (L4) to a polishing apparatus (9), said polishing solution feed device (L5) comprising a feed conduit (57) for feeding the polishing solution, and a flow-controllable bypass conduit (571) fluidly associated with the feed conduit (57), said flow-controllable bypass conduit (571) including a particle detector (8) for monitoring the polishing solution to detect large abrasive grains not smaller than a predetermined value and measure the number of the large abrasive grains, said particle detector (8) being a light-extinction particle detector irradiating a predetermined quantity of light on a flow cell fitted in a bypass conduit (571) so as to detect an attenuation of the light transmitted through the polishing solution flowing through the flow cell, the attenuation indicating the presence of the large abrasive grains, said flow cell allowing the polishing solution to flow therethrough at a constant flow rate by flow control of the bypass conduit (571).

10. An apparatus according to claim 9, wherein the particle detector (8) comprises a correction means for correcting deterioration in sensitivity thereof due to the abrasive grains having a particle size smaller than the predetermined value when detecting the attenuation of the transmitted light due to the large abrasive grains.

11. An apparatus according to claim 9, wherein the feed conduit (57) is provided with a first feed filter (62) for capturing the large abrasive grains, on an upstream side of the particle detector (8).

12. An apparatus according to claim 11, wherein the feed conduit (57) is provided with a second feed filter arranged parallel to the first feed filter (62) so as to change over the flow of the polishing solution fed, from the first feed filter (62) to the second feed filter when the particle detector (8) detects such a condition that the number of the large abrasive grains per a predetermined flow rate of the polishing solution exceeds a control limit.

13. An apparatus according to claim 9, further comprising a control device (10) for generating an alarm when the particle detector (8) detects such a condition that the number of the large abrasive grains per a predetermined flow rate of the polishing solution exceeds a control limit.

14. An apparatus according to claim 9, wherein each of the particle detectors (7) and (8) is provided with a comparison means comprising a specimen prepared by dispersing a standard substance in a polishing solution having a predetermined composition.

15. An apparatus for feeding a polishing solution comprising pure water and abrasive grains to a polishing apparatus (9), which apparatus comprises a feed conduit (57) extending from a polishing solution feed source (S1) to the polishing apparatus (9), and a flow-controllable bypass conduit (571) fluidly associated with the feed conduit (57), said flow-controllable bypass conduit (571) being provided with a particle detector (8) for monitoring the polishing solution so as to detect large abrasive grains not smaller than a predetermined value and measure the number of the large abrasive grains, wherein said particle detector (8) is a light-extinction particle detector irradiating a predetermined quantity of light on a flow cell (84) fitted in a bypass conduit (57) to detect an attenuation of the light transmitted through the polishing solution flowing through the flow cell (84), the attenuation indicating the presence of the large abrasive grains, said flow cell (84) allowing the polishing solution to flow therethrough at a constant flow rate by flow control of the bypass conduit (571).

16. An apparatus according to claim 15, wherein the particle detector (8) comprises a correction means for correcting deterioration in sensitivity thereof due to the abrasive grains having a particle size smaller than the predetermined value when detecting the attenuation of the transmitted light due to the large abrasive grains.

17. An apparatus according to claim 15, wherein the feed conduit (57) is provided with a first feed filter (62) for capturing the large abrasive grains, on an upstream side of the particle detector (8).

18. An apparatus according to claim 17, wherein the feed conduit (57) is provided with a second feed filter arranged parallel to the first feed filter (62) so as to change over the flow of the polishing solution from the first feed filter (62) to the second feed filter when the particle detector (8) detects such a condition that the number of the large abrasive grains per a predetermined flow rate of the polishing solution exceeds a control limit.

19. An apparatus according to claim 15, further comprising a warning means for generating an alarm when the particle detector (8) detects such a condition that the number of the large abrasive grains per a predetermined flow rate of the polishing solution exceeds a control limit.

20. An apparatus according to claim 15, wherein the particle detector (8) is provided with a comparison means comprising a specimen prepared by dispersing a standard substance in a polishing solution having a predetermined composition.

* * * * *